343-700 MS AU 254 EX

5/11/82 OR 4,329,689

United States Patent [19]

Yee

[11] 4,329,689

[45] May 11, 1982

[54] MICROSTRIP ANTENNA STRUCTURE HAVING STACKED MICROSTRIP ELEMENTS

[75] Inventor: James S. Yee, Seattle, Wash.

[73] Assignee: The Boeing Company, Seattle, Wash.

[21] Appl. No.: 949,565

[22] Filed: Oct. 10, 1978

[51] Int. Cl.[3] ..... H01Q 1/38

[52] U.S. Cl. ..... 343/700 MS; 343/829

[58] Field of Search ..... 343/700 MS, 830, 846

[56] References Cited

U.S. PATENT DOCUMENTS

| | | | |
|---|---|---|---|
| 4,089,003 | 5/1978 | Conroy | 343/700 MS |
| 4,131,892 | 12/1978 | Munson et al. | 343/700 MS |
| 4,131,893 | 12/1978 | Munson et al. | 343/846 |
| 4,138,684 | 2/1979 | Kerr | 343/846 |

*Primary Examiner*—Theodore M. Blum

*Attorney, Agent, or Firm*—Cole, Jensen & Puntigam

[57] ABSTRACT

The structure includes a ground plane and at least two stacked microstrip elements with each microstrip element comprising a conducting plane and a layer of dielectric material. The conducting planes and the intermediate dielectric layers are configured so that they resonate at closely spaced frequencies. Each conducting plane in the structure, except the top one, includes an opening which is large enough to permit sufficient electric field coupling to occur between the microstrip elements so that the individual response characteristics of the conducting planes merge to form a broadband response characteristic. The antenna of the present invention thus has a substantially improved bandwidth over prior art microstrip antennas.

11 Claims, 7 Drawing Figures

MICROSTRIP ANTENNA STRUCTURE HAVING STACKED MICROSTRIP ELEMENTS

BACKGROUND OF THE INVENTION

This invention relates generally to the art of microstrip antennas, and more particularly concerns microstrip antennas having a plurality of stacked microstrip elements.

In general, a microstrip antenna, which is a radiating element, comprises a ground plane of electrically conducting material, an intermediate layer of dielectric material, and an upper conducting plane. The conducting plane is electrically fed either from the side, or from below through the ground plane and the dielectric layer. Such a microstrip antenna is excited like a cavity, with a radiating electric field being established between the respective edges of the ground plane and the conducting plane.

Microstrip antennas have several significant advantages which make them particularly suitable for use in airborne, satellite, and similar applications. Other types of antennas have better electrical properties than the microstrip antenna; however, a microstrip antenna is very light in weight, does not require much space, and being formable, can be integrated into other structures, such as the wing or body of an airplane.

However, the use of microstrip antennas in airborne applications has heretofore been restricted, due to the inherent narrow bandwidth of the microstrip antenna. Most systems which interface in a signal sense with antennas, such as a radar, usually operate over a bandwidth of approximately 10%, i.e. the antenna operates over a range of frequencies $\Delta F$ which is 10% of the center or resonant frequency of the antenna.

To interface effectively with other systems, the antenna should have a comparable bandwidth. Microstrip antennas, however, have a bandwidth of between 1-2%. In some applications, a narrow bandwidth antenna can be tolerated, and hence there has been some use of the microstrip antenna, although its narrow bandwidth has heretofore prevented its wide spread use in applications, i.e. airborne, for which it is otherwise ideally suited.

Various techniques have been used to improve the bandwidth of microstrip antennas. In one technique, a slot is cut in the conducting surface element, while in another technique, the thickness of the dielectric substrate is increased or the dielectric constant of the substrate is varied. Many of these techniques, however, have proven, for one reason or another, to be either impractical or to cause a serious degradation in antenna performance. Increasing the thickness of the dielectric substeate has been found to have the most profound effect on bandwidth, but increasing the substrate thickness defeats one of the primary advantages of the microstrip antenna, i.e. its small dimensions.

Accordingly, it is a general object of the present invention to provide a microstrip antenna which solves one or more problems of the prior art noted above.

It is another object of the present invention to provide such an antenna which has a bandwidth substantially greater than that previously obtained with microstrip antennas.

It is a further object of the present invention to provide such an increased bandwidth antenna which retains all of the other advantages of the conventional microstrip antenna.

It is an additional object of the present invention to provide such an increased bandwidth antenna without increasing substantially either the size or weight of the antenna.

SUMMARY OF THE INVENTION

Accordingly, the present invention includes a ground plane and at least two microstrip elements. The microstrip elements comprise a conducting plane and a layer of dielectric material, so that the antenna is a stacked arrangement of a ground plane topped by alternating layers of dielectric material and conducting planes. The conducting planes are dimensioned so that they will resonate at particular frequencies which are closely spaced. Further, those conducting planes intermediate of the ground plane and the uppermost conducting plane have openings therethrough which have sufficient area to permit substantial electric field coupling between the microstrip elements, so that, with the close spacing of the resonant frequencies of the conducting planes, a broadband response results.

DESCRIPTION OF THE DRAWINGS

A more thorough understanding of the invention may be obtained by a study of the following detailed description taken in connection with the accompanying drawings in which.

DESCRIPTION OF THE PREFERRED EMBODIMENT

Figure 1:
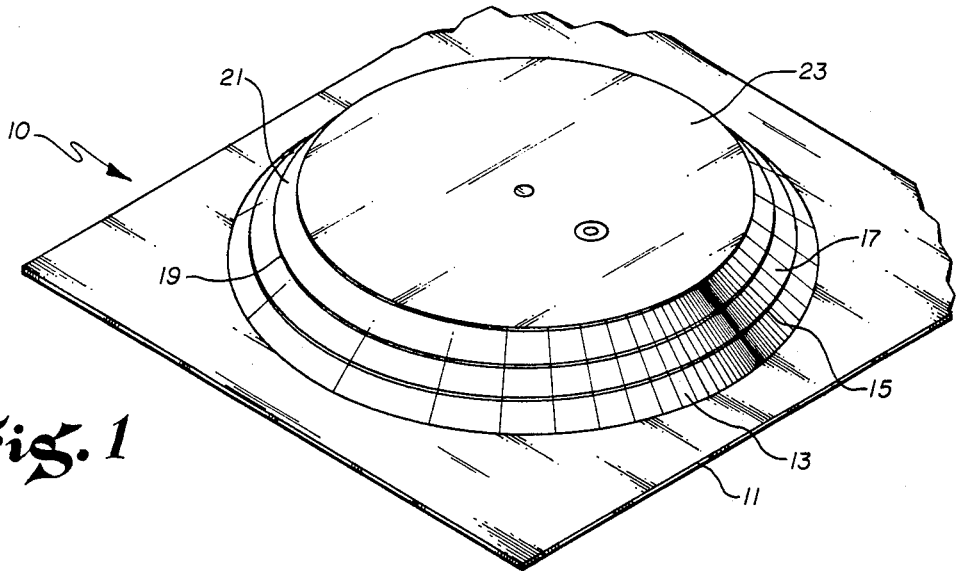
FIG. 1 is an isometric view of the microstrip antenna of the present invention.
Figure 2:
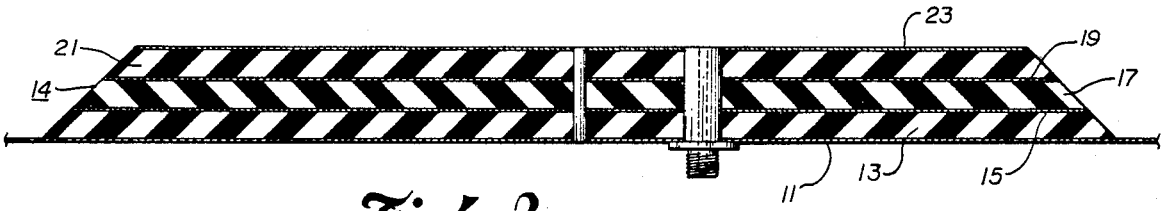
FIG. 2 is a cross-section view of the microstrip antenna of FIG. 1.
Figure 4:
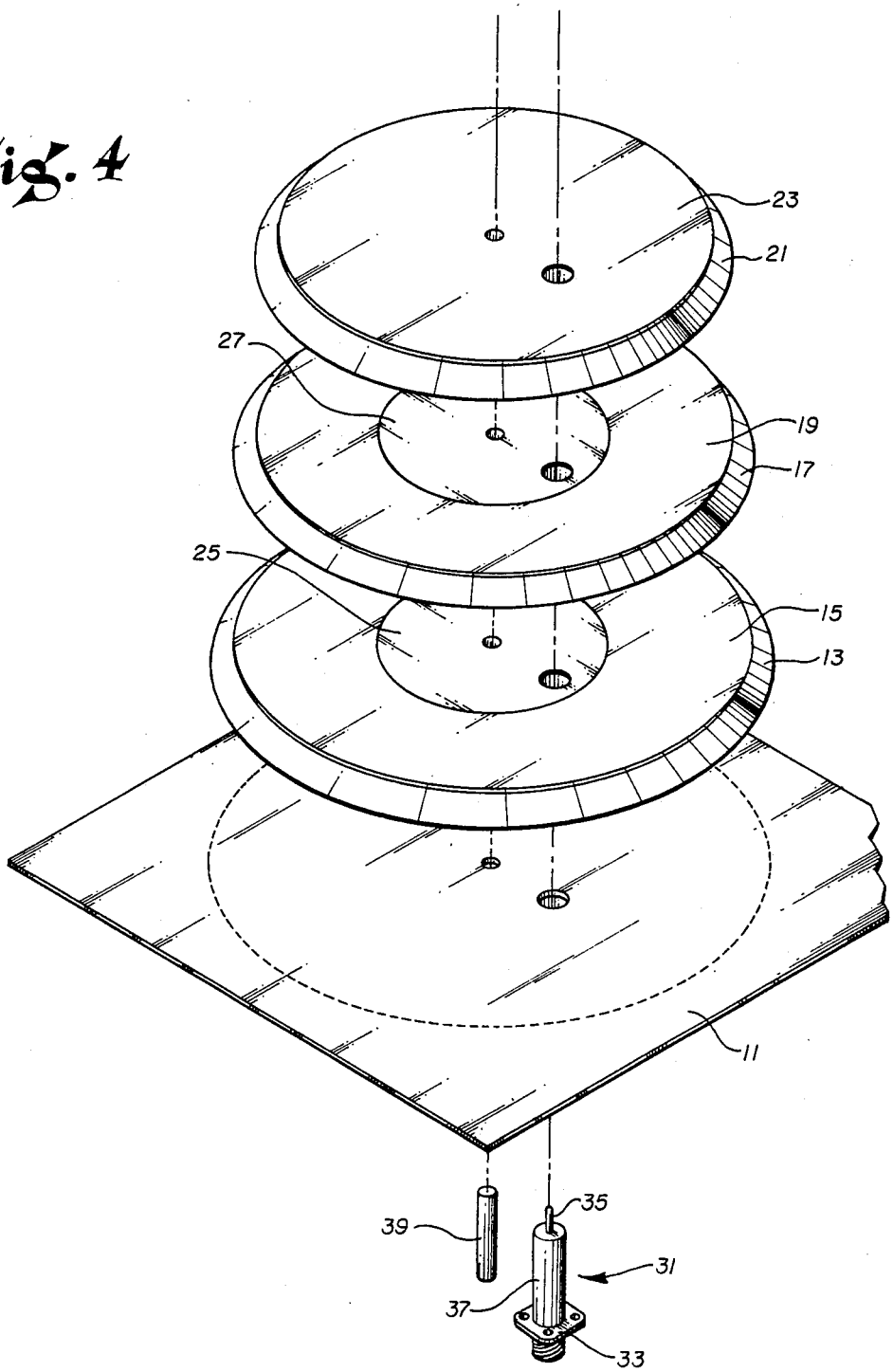
FIG. 4 is an exploded view of an antenna similar to that of FIG. 1, showing more clearly the features of the present invention.

Referring now to FIGS. 1, 2 and 4, a microstrip antenna having 3 microstrip elements is shown. Each microstrip element comprises a conducting plane and a layer of dielectric material, and in combination with a ground plane, will radiate electro magnetic energy. The novelty of the present invention lies in the configuration of the individual microstrip elements, as shown most clearly in FIG. 4 and described hereinafter.

Conventional microstrip antennas comprise a ground plane, a single intermediate layer of dielectric material, and a single conducting plane. The electric field which produces the radiation from the antenna is established between the edges of the ground plane and the conducting plane. The conducting plane is contoured so that the antenna will resonate at a particular frequency.

In the present invention, multiple alternating layers of dielectric substrate and conducting planes are stacked on the ground plane. The conducting planes are contoured to resonate at closely spaced frequencies. Electric field coupling between the conducting planes and the ground plane is achieved through an opening in the one or more conducting planes intermediate of the ground plane and the top conducting plane. The electric field coupling provided through the openings in the intermediate conducting planes, combined with the conventional coupling between the edges of the conducting planes and the ground plane, results in a significantly improved bandwidth for such an antenna over a single conducting plane microstrip antenna of comparable dimensions.

FIGS. 1, 2 and 4 all show a radiating element with three conducting planes, but it should be understood that structures using additional layers of dielectric material and additional conducting planes are within the contemplation of the present inventor. Further, even an antenna with just two conducting planes and two layers of dielectric material exhibits a marked improvement in bandwidth over a single conducting plane antenna.

Referring now in detail to FIGS. 1, 2 and 4, the base plane in the antenna structure shown generally at 10 is an electrically conducting ground plane 11. The ground plane 11 in the embodiment shown is a thin metallic disc, usually copper, approximately 0.0014 inches thick. It's length and width dimension are one or more wavelengths. It may take various configurations, including circular or square, for instance, with the microstrip elements, i.e. the conducting planes and the layers of dielectric material, being preferably located at its center.

The next layer in the antenna structure 10 is a first layer of dielectric material 13, which is typically a low loss material such as teflon glass or rexolite. The configuration of layer 13 is similar to that of its associated conducting plane. The conducting plane is usually the same size as its associated dielectric layer. The edge surface 14 of the dielectric layer 13 in the embodiment shown is beveled so as to provide a continuous flat surface at the edge of the antenna instead of a stepped configuration between adjacent conducting planes.

The dielectric layer 13 may be of various thicknesses but in the embodiment shown is approximately 1/16th of an inch. Generally, the design constraints on a microstrip antenna will specify a certain total thickness. The thickness of the individual layers of dielectric material in the antenna, which comprise most of the thickness dimension of the antenna, will depend upon the number of conducting planes to be stacked in the antenna. Generally, however, it is not desirable that the thickness of the dielectric layers decrease much below 1/16th inch.

Dielectric layer 13 is bonded to the ground plane 11 by a conventional adhesive used in copper clad circuit boards, and a first conducting plane 15 is similarly bonded to the upper surface of the first dielectric layer 13. The first conducting plane 15 is a thin disc of electrically conducting material, such as copper, similar to that which comprises ground plane 11. The first conducting plane 15 is configured to operate at a first particular resonant frequency.

A second layer of dielectric material 17 and a second conducting plane 19 are then stacked on top of the first conducting plane 15. The second conducting plane 19 is substantially identical to the first conducting plane 15, except that it is tailored in size to resonate at a slightly different frequency, i.e. a second particular frequency. A third dielectric substrate 21 and a third conducting plane 23 are stacked on top of the second conducting plane 19 in the embodiment shown. Further layers of dielectric material and conducting planes may be added, if necessary.

A substantial number of applications for microstrip antennas are in the L band frequency range; other applications are in the S and X bands. Operating in the L band, for instance, the first conducting plane 15 might in one embodiment be tailored to resonate at 960 megahertz, while the resonant frequency of the second and third conducting planes would be 980 megahertz and 1000 megahertz, respectively. The frequency spacing depends on the inherent bandwidth characteristics of the individual microstrip radiating elements. FIG. 3*c* shows the combined response of such an embodiment, with overlap of the response curves at approximately 970 and 990 megahertz.

Figure 3A:
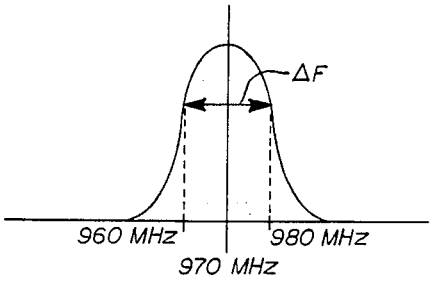
FIGS. 3*a*, 3*b*, 3*c* and 3*d* are response curves for various microstrip antennas which include, respectively, (1) a single conducting plane, (2) two conducting planes configured to produce discrete, separated frequencies, (3) three conducting planes configured to produce a broad band response, and (4) the response resultant of the three conducting planes of FIG. 3*c* using the principles of the present invention.

FIG. 3*a* is a typical response curve for a microstrip antenna having a single conducting plane. If the conducting plane has a frequency of 970 megahertz, a 2% bandwidth would result in a response frequency range $\Delta F$ of approximately 960–980 megahertz.

Figure 3B:
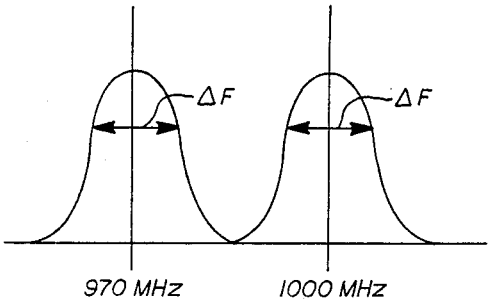
Figure 3C:
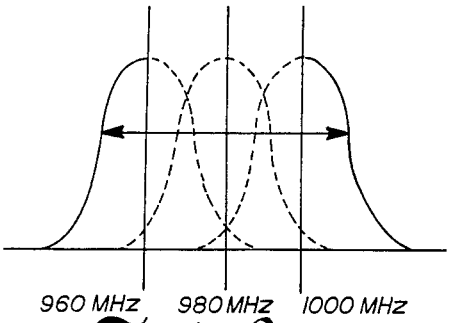

FIG. 3*b* shows a response of a microstrip antenna having two stacked conducting planes with resonant frequencies sufficiently separated so that there is no interaction between them. Each response curve individually may be similar in configuration to that of FIG. 3*a*. With resonant frequencies of, for example, 970 megahertz and 1000 megahertz, a dual frequency response, rather than a broadband response, results.

FIG. 3*c*, as noted briefly above, shows a set of response curves wherein the individual microstrip elements have respective resonant frequencies of 960, 980 and 1000 megahertz. Such a frequency distribution results in an overlap in response curves, as shown in FIG. 3*c*.

Although FIGS. 1, 2 and 4 show a stack of three layers dielectric material and three associated conducting planes, it should be recognized that fewer (e.g. two) or more layers of dielectric and conducting planes may be provided, with each conducting plane and associated dielectric layer being tailored to a resonant frequency slightly different than the other conducting planes and associated dielectric layers. The dielectric layers are configured to provide a continuous edge surface between adjacent conducting planes. The more conductive planes and dielectric layers, the wider is the theoretical bandwidth of the antenna.

It has been discovered by applicant, however, that the mere stacking of conducting planes and dielectric layers, no matter how close the resonant frequencies of the conducting planes, is not sufficient to provide the desired broad band response, i.e. the overlap is not sufficient. Apparently this is due to the lack of sufficient coupling between the stacked microstrip elements.

To provide the required degree of coupling, an opening is provided in each of those conducting planes intermediate of the ground plane 11 and the top conducting plane 23. In the case of a two conducting plane antenna, only the first conducting plane will have an opening, while in a three conducting plane antenna, such as shown in FIGS. 1, 2 and 4, the first and second conducting planes have the openings.

Referring now specifically to FIG. 4, which shows the openings most clearly, the antenna shown therein has a ground plane 11, a first layer of dielectric material 13 and a first conducting plane 15. The first conducting plane 15 is approximately 4.45 inches in diameter. The conducting planes are very thin discs, while the dielectric layers are approximately 1/16th inch thick. In the first conducting plane 15, a circular opening 25, 2" in diameter, is provided central thereof to provide the coupling required.

In the embodiment shown, the second conducting surface plane has a diameter of approximately 4.4 inches. The second conducting plane 19 also has an opening 27, approximately equal to the opening in the first conducting plane 15. The diameter of the second dielectric layer 17 decreases gradually from conducting plane 15 to conducting plane 19. The thickness of the dielectric layer is again about 1/16th inch. The third conducting plane 23 is approximately 4.35 inches in diameter and has no central opening because it is the top conducting plane and is hence exposed. The third dielectric layer 21 is approximately 1/16th inch in thickness and has a diameter which decreases between the second and third conducting planes.

The openings 25 and 27 in the intermediate conducting planes 15 and 19 may take various configurations in addition to the circular configuration shown, and also may be of various sizes. Furthermore, there may be more than one opening in the intermediate conducting planes, and the openings may be located at various positions in the conducting planes. Although the size, spacing and positioning of the openings may be varied, the important criterion is to provide the proper degree of coupling between the various microstrip elements, i.e. the successive stacked combinations of conducting planes and the dielectric layers, which comprise, with the ground plane, the antenna.

Figure 3D:
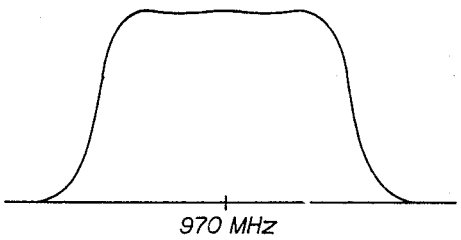

The additional coupling provided results in a true broad band response for the radiating element. The individual curves of adjacent conducting surface planes, as shown in FIG. 3*c*, merge into a single, broad band, response curve, such as shown in FIG. 3*d*.

In addition to improved performance by virtue of the increased coupling, a portion of one of the openings or additional openings may be used to house one or more active elements, such as an amplifier, to further increase performance.

A grounding pin 39 may be provided in conventional fashion through the center of the antenna structure in order to provide a ground for the antenna. The grounding pin is electrically connected to the top conducting plane in the antenna and the ground plane, such as by soldering.

The final portion of the radiating element is the feed for energizing the antenna. The antenna can be energized in several ways, although it is simplest in the present embodiment to extend the feed vertically through the various parts of the antenna from the bottom to the top thereof.

As an example, the feed may be a standard 50 ohm coax connector 31 with dielectric sleeve 37, which extends through the stacked microstrip elements from the connector plate 33. The coax center conductor 35 extends through openings in the ground plane and the intermediate dielectric layers and conducting planes. The coax center conductor 35 is electrically connected, such as by soldering, to the top conducting plane. Such an arrangement is referred to as a single feed, and is shown in FIG. 4.

Another arrangement is referred to as a balanced feed. A balanced feed arrangement requires two 50 ohm coax connectors and a 180° 3 db hybrid circuit. The two hybrid outputs each provide one-half of the input power to each feed point. Each feed point is offset from the center of the antenna, although the offset distances may be different for a better impedance match. The balanced feed arrangement has been found to yield a slightly wider bandwidth characteristic than the single feed, but it does require an additional connector and a hybrid circuit.

With both types of feed arrangement, the dielectric sleeve 37 usually remains on the center conductor 35, with just the tip of the center conductor 35 being exposed. In certain circumstances, however, the dielectric sleeve may be removed and the center conductor thus exposed from the connector to the top conducting plane. All of the above feed configurations have proven to be successful.

Hence, a microstrip antenna has been disclosed which has a bandwidth at least as great as 6% and possibly higher, even up to 10%. This is a significant bandwidth improvement over existing microstrip antennas. The antenna disclosed is compatible with nearly all signal interfaces, and may be used in many applications, such as airborne and space, where it is otherwise ideally suited, but has not been heretofore used extensively because of bandwidth limitations.

Although an exemplary embodiment of the invention has been disclosed herein for purposes of illustration, it should be understood that various changes, modifications and substitutions may be incorporated in such embodiment without departing from the spirit of the invention as defined by the claims which follow.

I claim:

1. A microstrip antenna, comprising:

a ground plane;

at least two microstrip elements disposed in a stack on top of said ground plane means, wherein each microstrip element comprises a conducting plane and a layer of dielectric material;

wherein the conducting planes are dimensioned to resonate at given frequencies which are relatively close to each other and wherein at least those conducting plates intermediate of said ground plane and the uppermost conducting plane have openings therethrough sufficient in area and located relative to each other such that in operation substantial electric field coupling occurs between the microstrip elements, thereby resulting in a microstrip antenna having a broadband frequency response covering said given frequencies.

2. An apparatus of claim 1, wherein said openings are unoccupied by active elements.

3. An apparatus of claim 1, wherein said openings are substantially larger than that necessary to pass either an antenna feed means or a grounding pin means.

4. An apparatus of claim 1, wherein the conducting planes are thin sheets of electrically conducting material and wherein said dielectric layers are relatively thick compared to the thickness of the conducting planes.

5. An apparatus of claim 4, wherein said conducting planes have substantially similar configurations but decrease slightly in dimension from said ground plane to said uppermost conducting plane.

6. An apparatus of claim 5, wherein the edge of each dielectric layer is configured so that the edge of the antenna is a straight line.

7. An apparatus of claim 6, including antenna feed means having a central conductor which extends through the antenna from the ground plane to the uppermost conducting plane, and wherein the central conductor of said feed means is secured electrically to the uppermost conducting plane.

8. An apparatus of claim 7, wherein the central conductor is insulated except for the portion thereof which contacts said uppermost conducting plane.

9. An apparatus of claim 1, wherein only said intermediate conducting planes include said openings, and wherein said openings are substantially identical in configuration.

10. An apparatus of claim 9, wherein said openings are substantially the same size.

11. An apparatus of claim 10, wherein said openings are positioned substantially central of each intermediate conducting plane.

* * * * *